US010000969B2

(12) United States Patent
Grasmann et al.

(10) Patent No.: US 10,000,969 B2
(45) Date of Patent: Jun. 19, 2018

(54) ACCESS CONTROL APPARATUS

(71) Applicant: SKIDATA AG, Grödig/Salzburg (AT)

(72) Inventors: Thomas Grasmann, Grödig (AT); Christian Tuma, Grödig/Fürstenbrunn (AT)

(73) Assignee: Skidata AG, Grödig/Salzburg (AT)

( * ) Notice: Subject to any disclaimer, the term of this patent is extended or adjusted under 35 U.S.C. 154(b) by 0 days. days.

(21) Appl. No.: 15/185,502

(22) Filed: Jun. 17, 2016

(65) Prior Publication Data

US 2016/0369559 A1 Dec. 22, 2016

(30) Foreign Application Priority Data

Jun. 19, 2015 (DE) ..... 20 2015 103 247 U

(51) Int. Cl.

| | |
|---|---|
| ***E06B 11/02*** | (2006.01) |
| ***E06B 11/08*** | (2006.01) |
| ***E01F 13/06*** | (2006.01) |
| ***F21V 23/00*** | (2015.01) |
| ***F21V 33/00*** | (2006.01) |
| *E06B 9/00* | (2006.01) |
| *F21Y 113/10* | (2016.01) |
| *F21Y 115/10* | (2016.01) |

(52) U.S. Cl.

CPC ..... *E06B 11/02* (2013.01); *E01F 13/06* (2013.01); *E06B 11/08* (2013.01); *F21V 23/003* (2013.01); *F21V 33/00* (2013.01); *E06B 2009/002* (2013.01); *F21Y 2113/10* (2016.08); *F21Y 2115/10* (2016.08)

(58) Field of Classification Search

CPC ..... E01F 9/20

See application file for complete search history.

(56) References Cited

U.S. PATENT DOCUMENTS

| | | | | |
|---|---|---|---|---|
| 4,811,516 | A | 3/1989 | Anderson | |
| 6,487,818 | B1 * | 12/2002 | Hamann | E01F 13/06 49/13 |
| 7,258,461 | B1 * | 8/2007 | Izardel | E01F 13/04 362/152 |
| 8,011,797 | B2 * | 9/2011 | Rihl | E01F 13/06 362/152 |
| 8,115,411 | B2 * | 2/2012 | Shan | H05B 37/02 315/294 |

(Continued)

FOREIGN PATENT DOCUMENTS

| | | | | |
|---|---|---|---|---|
| AT | 390302 B | * | 4/1990 | E06B 11/08 |
| AT | 390302 B | | 4/1990 | |

(Continued)

OTHER PUBLICATIONS

Machine translation of DE202010006973U1.*

German Search Report issued in corresponding German Patent Application No. 20 2015 103 247.1 dated May 12, 2016, 6 Pages.

*Primary Examiner* — Marcus Menezes

(74) *Attorney, Agent, or Firm* — Davis & Bujold PLLC; Michael J. Bujold

(57) ABSTRACT

An access control apparatus for persons or motor vehicles can be illuminated on both sides facing the persons or motor vehicles arriving along the access track or lane. Lighting is assigned to each side can be controlled independently from the lighting of the other side, and the illumination of each side can only be perceived by persons facing the respective side.

3 Claims, 3 Drawing Sheets

(56) References Cited

U.S. PATENT DOCUMENTS

| | | | | |
|---|---|---|---|---|
| D707,851 | S * | 6/2014 | Pikman | D25/48.5 |
| 8,845,125 | B1 * | 9/2014 | Lumsden | E01F 13/06 340/908 |
| 9,024,515 | B2 | 5/2015 | Melkes et al. | |
| 2007/0124998 | A1 * | 6/2007 | Guedon | E01F 13/06 49/49 |
| 2007/0199243 | A1 * | 8/2007 | Youn | E01F 13/06 49/49 |
| 2011/0113662 | A1 * | 5/2011 | Saunders | E01F 13/06 40/582 |
| 2013/0133264 | A1 * | 5/2013 | Melkes | E01F 13/06 49/49 |
| 2014/0363229 | A1 | 12/2014 | Lumsden et al. | |
| 2015/0033628 | A1 * | 2/2015 | Barwick | E06B 11/085 49/13 |

FOREIGN PATENT DOCUMENTS

| | | | | |
|---|---|---|---|---|
| DE | 202010006973 | * | 9/2010 | E01F 13/06 |
| DE | 202010006973 | U1 | 9/2010 | |
| EP | 2 105 534 | A2 | 9/2009 | |
| EP | 2 527 536 | A1 | 11/2012 | |

* cited by examiner

ACCESS CONTROL APPARATUS

This application claims priority to German patent application serial no. 20 2015 103 247.1 filed Jun. 19, 2015.

FIELD OF THE INVENTION

The present invention relates to an access control apparatus for persons or vehicles.

BACKGROUND OF THE INVENTION

Such access control apparatuses are known from the prior art. They comprise a reading unit in order to read the data required for verifying the validity of an access authorisation. The reading unit is usually formed in such a way that contactless reading of the access authorisation is enabled. For this purpose, the reading units comprise an antenna unit for example which communicates with an RFID transponder used as a data carrier, on which the access authorisations are stored.

Such access control apparatuses further comprise a barrier element which is actuated by an actuator controlled via a controller in order to allow a person or a vehicle to enter or leave a building or a property. In the process, the barrier element is moved from a blocking position to an open position when reading out a valid access authorisation.

The barrier element is usually formed as a turnstile or rotating barrier in the event of access control apparatuses for persons. Furthermore, access control apparatuses for persons can be formed as "flap gates", which on their part can be formed with a single arm or two arms. In the case of a flap gate, at least one blocking arm or at least one blocking flap protrudes into the access track and folds upwardly in the case of access authorisation that was read out with validity.

In the case of access control apparatuses for motor vehicles, the blocking element is usually formed as a vehicle barrier comprising a barrier column, a barrier arm and a drive for pivoting the barrier arm between the blocking and open position. The barrier arm can be formed as a foldable arm and comprise two barrier arm sections and a pivot which is pivotable about a horizontal axis and which connects the two barrier arm sections to each other, wherein one barrier arm section is connected to the drive for pivoting the barrier arm.

It is known from the prior art to provide barrier arms of vehicle barriers with illuminating light-emitting diodes (LEDs), which are arranged on the side of the barrier arm in order to indicate to the drivers of the arriving vehicles an open position by means of the colour green and a blocking position by means of the colour red, as disclosed for example in U.S. Pat. No. 7,258,461 B1.

Barrier arms are further known which are formed as a light-transmissive tube, in which a strip provided with light-emitting diodes is arranged. It is advantageous in this embodiment that the barrier arm is formed in a well-visible manner in order to avoid damage. Such a barrier arm is known from EP 2105534 A2.

Barrier arms are further known which are formed as tube sections, wherein at least one luminous element is respectively arranged in a lens at an end of the tube section, which lens enables straight light scattering substantially parallel to the longitudinal axis of the tube section in the direction of the other end of the tube section, and wherein at least one device for reflection of the emitted light is arranged at the other end. As a result of this concept, the barrier arm is illuminated without the possibility of providing a plurality of LEDs over the entire length, as known from EP 2527536.

In the case of access control apparatuses for motor vehicles known from the prior art, either the entire barrier arm can be illuminated uniformly or only one side of the barrier arm is illuminated in order to indicate an open and blocking position. This requires a predetermined direction for the arriving vehicles since the side of the access control apparatus facing the arriving vehicles needs to be illuminatable.

In the case of access control apparatuses for persons according to the prior art, the arriving persons are signaled by means of a lighting apparatus which is arranged on the side of the access control apparatus facing the arriving persons that access is possible (green colour) or not possible (red colour). In this case too, a predefined direction for the arriving persons is assumed.

In practice however, access control apparatuses for motor vehicles and persons are associated with a lane or access track and not only one direction along said track, namely the direction for entering or the direction for leaving an area. For example, most access control apparatuses can be assigned to the drive-in or entrance direction in the case of parking garages and exhibitions during the morning, wherein most access control apparatuses are assigned to the drive-out or exit direction during the afternoon.

It may further occur in access control apparatuses for motor vehicles which are known from the prior art and which can only be illuminated on one side that during darkness vehicles arriving on the opposite, non-illuminatable side can damage the barrier arm since this side is not illuminated, wherein disadvantageously the drivers of the vehicles arriving on the opposite, non-illuminatable side are additionally unable to recognise whether the access control apparatus is assigned to the drive-in or drive-out direction.

It can also occur in access control apparatuses for persons which can only be illuminated on one side according to the prior art in order to signalise by means of the colours red and green to the persons facing said side whether access is possible or not that the persons situated on the side of the access control apparatus opposite the illuminatable side are not provided with any information whether or not access via said access control apparatus is currently possible.

SUMMARY OF THE INVENTION

The present invention is therefore based on the object of providing an access control apparatus for persons of vehicles through the use of which the aforementioned disadvantages known from the prior art are avoided.

This object is achieved by the features of the independent claim(s). Further embodiments and advantages are provided in the dependent claims.

An access control apparatus for persons or vehicles is thus proposed which can be illuminated at the two sides facing the persons or vehicles arriving along the access track or lane, wherein the lighting means assigned to each side can be controlled independently of the lighting means of the other side, and wherein the illumination of each side can only be perceived by persons facing said side. The lighting means are preferably formed as controllable RGB LEDs.

It is proposed in accordance with the invention in the case of an access control apparatus for motor vehicles comprising a barrier arm to form the barrier arm as a tube section of rectangular cross-section, whose two sides facing the motor vehicles arriving along the lane are formed in a light-transmissive or transparent manner, wherein a light-impermeable separating wall which is light-reflective in both directions and extends between two diagonally opposite edges is arranged within the barrier arm. Furthermore, controllable LEDs are arranged on the sides of the barrier arm which are arranged parallel to the plane of the lane in the blocking position of the barrier arm, which LEDs shine inwardly in the direction of the separating wall, wherein the LEDs of each side can be controlled independently of the LEDs of the other side. In the event that the barrier arm is formed as a foldable arm, both barrier arm sections or only one barrier arm section can be formed in accordance with the invention.

As a result of this configuration, the light emitted by the LEDs on one side is reflected by the light-reflective separating wall, as a result of which the barrier arm is illuminated with the desired colour and intensity on a side facing the motor vehicles arriving along the lane. It is thus possible to illuminate the sides of the barrier arm facing the motor vehicles arriving along the lane independently from each other in order to indicate the access direction currently assigned to the barrier arm (drive-in or drive-out direction). If for example the access control apparatus is assigned to the drive-in direction, the side of the barrier arm facing the vehicles arriving in the drive-in direction for example is illuminated in green or blue in order to indicate allowed access (green) or currently still blocked access (blue), wherein the opposite side is illuminated in red in order to signal that access is not enabled. Furthermore, further colours can be selected as required, which can be set by means of the control of the LEDs.

The configuration in accordance with the invention further allows high flexibility because an access control apparatus formed in accordance with the invention for motor vehicles can be assigned as required to the drive-in or drive-out direction by setting the illumination and respective adjustment of the control of the reading unit of the sides of the barrier arm facing the motor vehicles arriving along the lane. As a result of the contactless reading of the access authorisations, the arrangement of the reading unit of the access control apparatus is irrelevant with respect to the arriving vehicles.

It is proposed in the case of access control apparatuses for persons to provide the access control apparatuses with a lighting apparatus which comprises respectively independently controllable LEDs on the sides facing the persons arriving on the access track, which LEDs are controlled in such a way that the access direction currently assigned to an access control apparatus is displayed (entrance or exit direction). If for example the access control apparatus is assigned to the entrance direction, the side facing the persons arriving in the entrance direction is illuminated in green and the opposite side in red. If the access control apparatus is assigned to the exit direction, the side facing the persons arriving in the exit direction is illuminated in green and the opposite side in red. Furthermore, further colours can be selected as required which are adjustable by means of the control of the LEDs.

BRIEF DESCRIPTION OF THE DRAWINGS

The invention will be explained below in closer detail by reference to examples shown in the drawings, wherein.

DETAILED DESCRIPTION OF PREFERRED EMBODIMENTS

Figure 1:
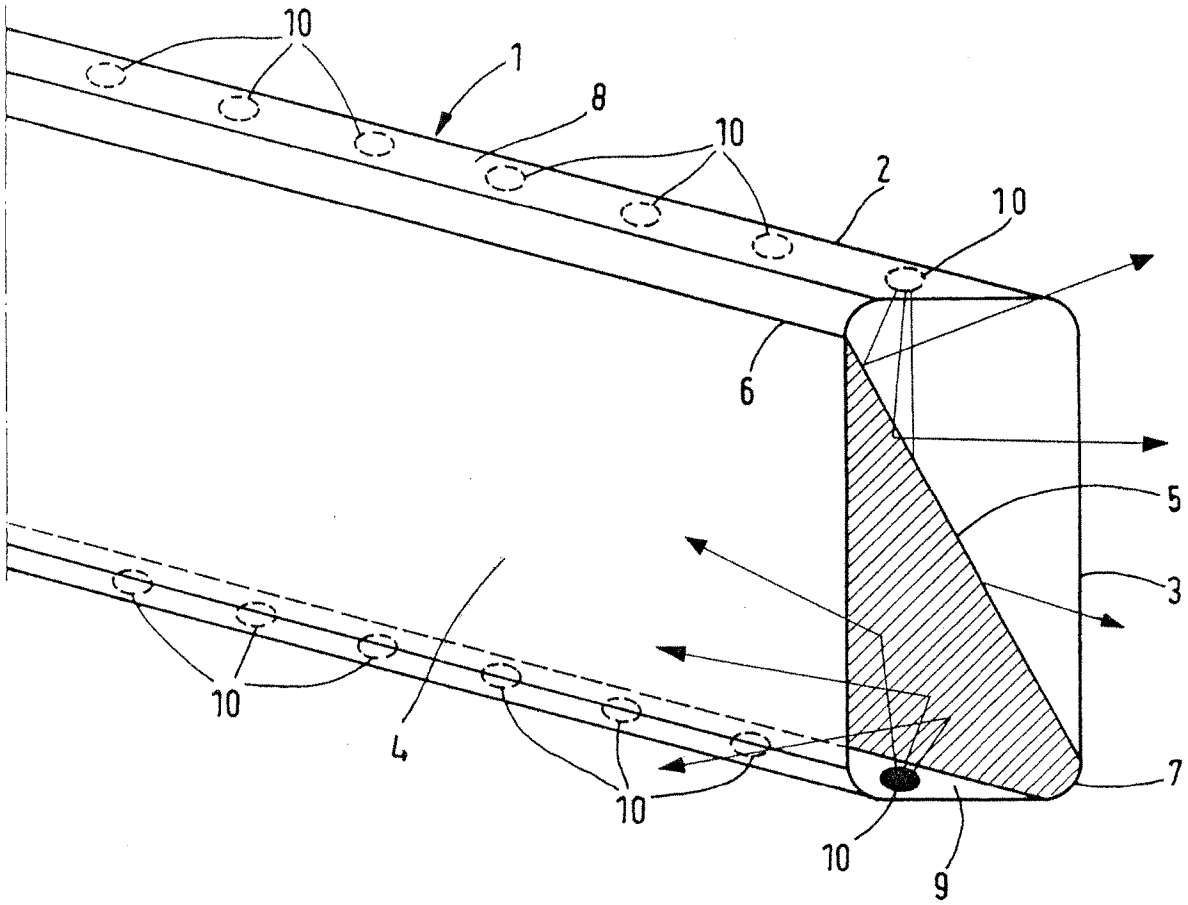
FIG. 1 shows a perspective view of a part of a barrier arm of an access control apparatuses for motor vehicle, said barrier arm being formed in accordance with the invention.

In accordance with the invention and with reference to FIG. 1, the barrier arm 1 of an access control apparatus for motor vehicles is formed as a tube section 2 of substantially rectangular cross-section, whose two sides 3, 4 facing the motor vehicles arriving along the lane 18 (FIG. 2) are formed in a light-transmissive or transparent manner, wherein a light-impermeable separating wall 5, which is light-reflective in both directions and extends between two diagonally opposite edges 6, 7 of the tube section 2, is arranged within the barrier arm 1.

As is shown in FIG. 1, controllable LEDs 10 are arranged on the sides 8, 9 of the barrier arm 1 arranged in parallel to the plane of the lane in the blocking position of the barrier arm 1, which sides correspond to the upper and bottom side of the barrier arm 1 in the blocking position, which LEDs shine inwardly in the direction of the opposite side and thus towards the separating wall 5, wherein the LEDs 10 of each side 8, 9 can be controlled independently of the LEDs 10 of the other side. The sides 8, 9 of the barrier arm 1 which are arranged parallel to the plane of the lane in the blocking position of the barrier arm 1 are preferably formed in a light-impermeable manner.

The light emitted by the LEDs 10 of the sides 8, 9 is reflected by the light-reflective separating wall 5, as indicated by the arrows in FIG. 1, as a result of which the barrier arm 1 can respectively be illuminated with the desired colour and intensity on the sides 3, 4 facing the motor vehicle arriving along the lane.

Figure 2:
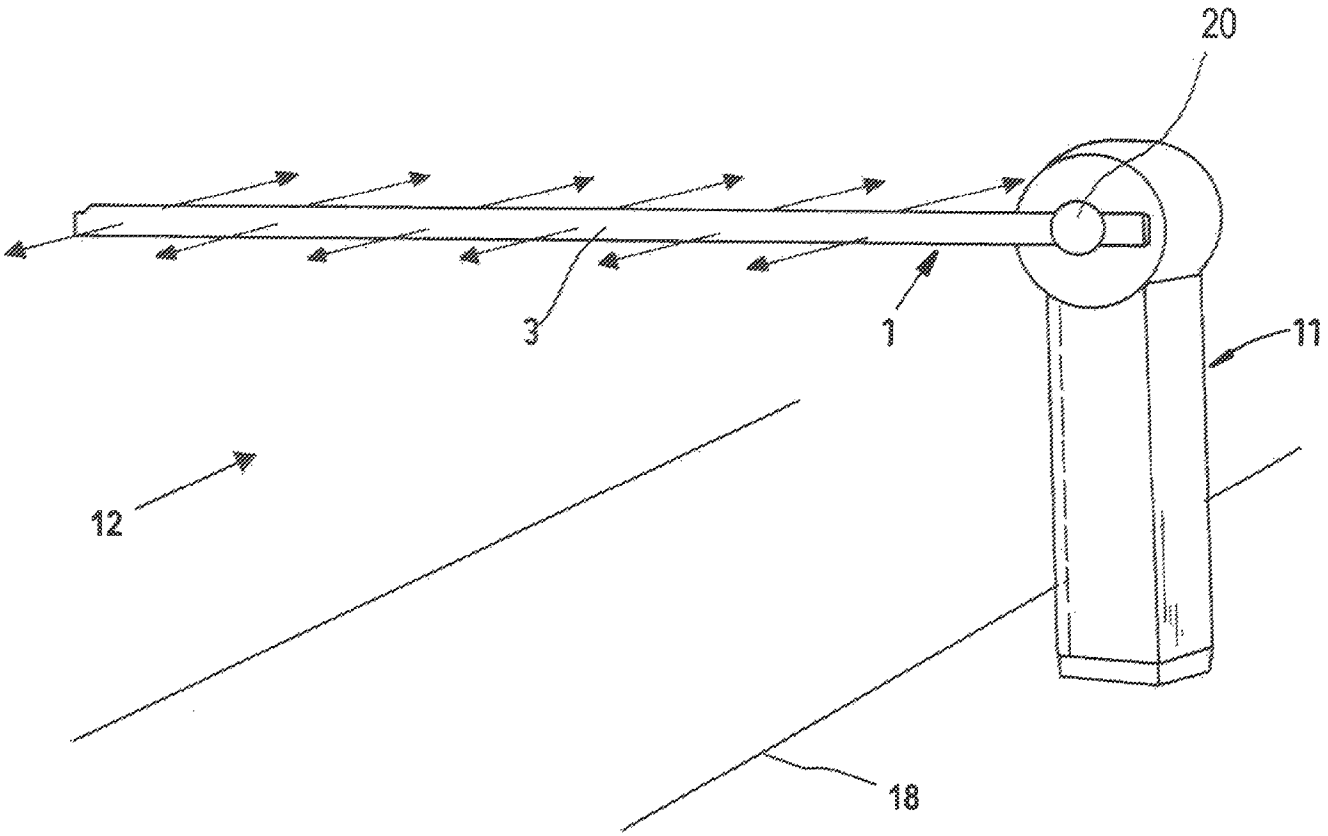
FIG. 2 shows a perspective view of an access control apparatus formed in accordance with the invention for motor vehicles.

As a result, the sides 3, 4 facing the motor vehicles arriving along the lane can advantageously be illuminated independently from each other, which is illustrated by means of FIG. 2. FIG. 2 shows a vehicle barrier, comprising a barrier column 11, a barrier arm 1 and a drive 20 for pivoting the barrier arm 1 between the blocking and open position. If for example the access control apparatus is assigned to the drive-in direction, which is indicated by the arrow 12, the side 3 of the barrier arm 1 which faces the vehicles arriving in the drive-in direction is illuminated in green, wherein the opposite side 4 is illuminated in red. It is understood that further colours can be selected as required, which are adjustable by means of controlling the LEDs 10.

Figure 3:
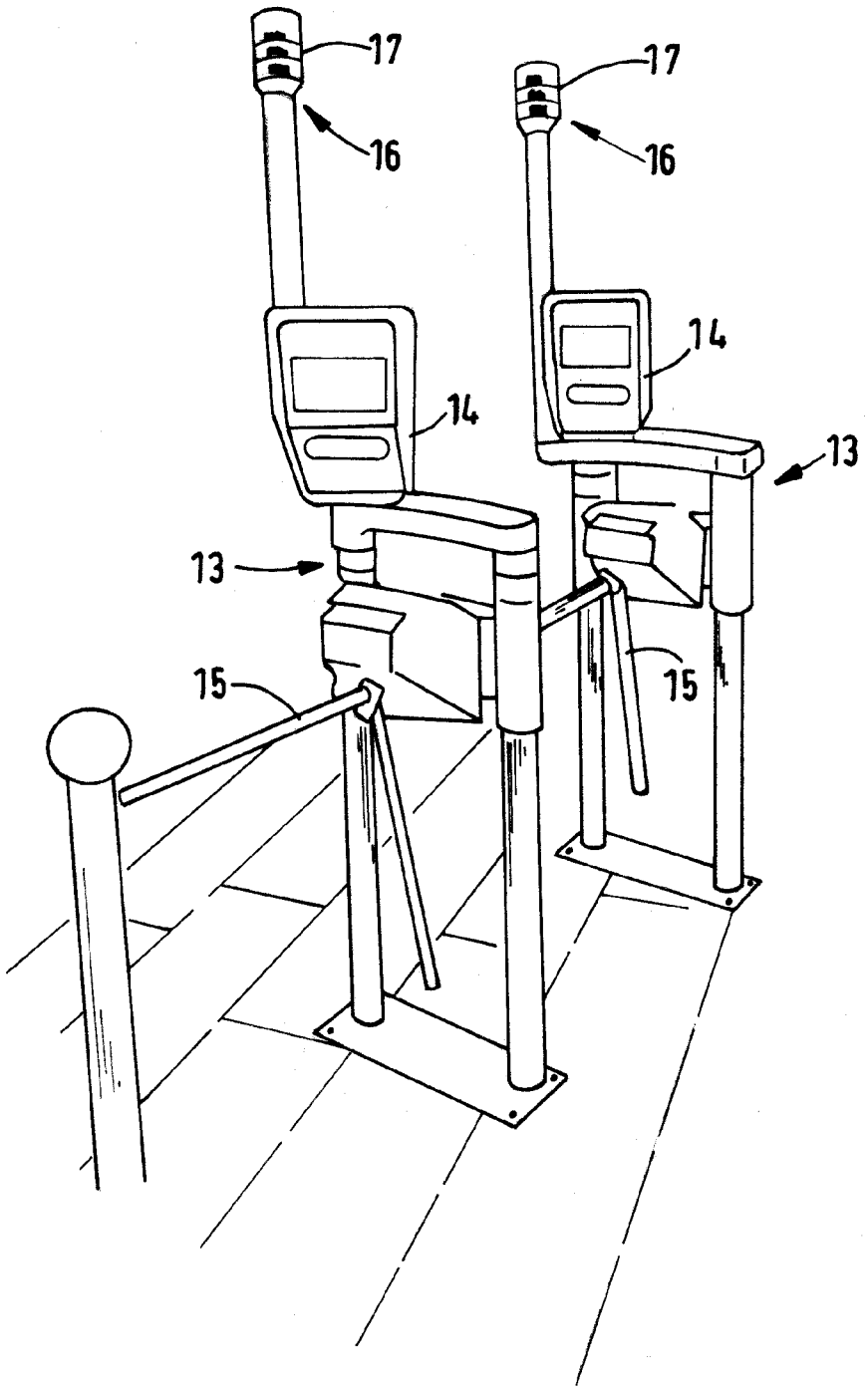
FIG. 3 shows a perspective view of an access control apparatus formed in accordance with the invention for persons.

The subject matter of FIG. 3 are two access control apparatuses 13 for persons, each comprising a reading unit 14 and a barrier element which is formed in the illustrated example as a rotating barrier 15, which comprise a lighting apparatus 16 in accordance with the invention, which comprises independently controllable LEDs 17 on the sides facing the persons arriving along the access track, which LEDs can be controlled in such a way that when an access control apparatus is assigned to the entrance direction the side facing the persons arriving in the entrance direction is illuminated in green and the opposite side in red. When on the other hand an access control apparatus is assigned to the exit direction, the side facing the persons arriving in the exit direction is illuminated in green and the opposite side in red.

Furthermore, further colours can be selected as required, which are adjustable by means of controlling the LEDs for each side.

The invention claimed is:

1. An access control apparatus for persons or motor vehicles, the access control apparatus comprising a first side, and a second side being opposite the first side, the access control apparatus being positioned along an access track or lane such that both of the first and the second sides face persons or motor vehicles arriving along the access track or the lane, a first lighting means for illuminating the first side of the access control apparatus and being controlled independently from a second lighting means for illuminating the second side of the access control apparatus, and the illumination of the first side is only perceived by persons facing the first side of the access control apparatus, and the illumination of the second side is only perceived by persons facing the second side of the access control apparatus, the first and the second sides each having an upper edge and a lower edge, the upper edges of the first and the second sides being connected by a top side and the lower edges of the first and the second sides being connected by a bottom side, a separating wall extends diagonally from the upper edge of the first side to the lower edge of the second side such that the separating wall forms an acute angle with each of the top and bottom sides and reflects light from the first and the second lighting means through the first and the second sides, respectively.

2. The access control apparatus according to claim 1, comprising a barrier arm (1) and a drive for pivoting the barrier arm (1) between a blocking position and an open position, the barrier arm (1) is formed as a tube section (2) having a rectangular cross-section and comprising the first and the second sides (3, 4) of the access control apparatus which face the motor vehicles arriving along the lane from opposite directions, and the first and the second sides being either light-transmissive or transparent, the separating wall (5) being light-impermeable and light-reflective and extending diagonally in the tube section (2) from the upper edge of the first side to the lower edge of the second side, and the first and the second lighting means are controllable LEDs (10) arranged on the bottom and the top sides (8, 9), respectively, and the bottom and the top sides are arranged parallel to a plane of the lane when the barrier arm is pivoted in the blocking position, the LEDs on each of the bottom and the top sides shine light inwardly in a direction toward the separating wall (5), the LEDs (10) of the bottom side are independently controllable from the LEDs (10) of the top side.

3. An access control apparatus for either persons or motor vehicles, the access control apparatus being positioned along an access track or lane and facing persons or motor vehicles approaching the access control apparatus along the access track or lane, the access control apparatus comprising a first lighting source which emits light from a first side of the access control apparatus in a first direction along the access track or lane, the first lighting source being controlled independently from a second lighting source, the second lighting source emitting light from a second side of the access control apparatus in a second direction opposite the first direction along the access track or lane, and illumination of each of the first and the second sides of the access control apparatus is only perceived by a person facing the first and the second sides of the access control apparatus, respectively, the access control apparatus comprises a barrier arm having opposite axial ends, one of the axial ends of the barrier arm being coupled to a drive mounted on a barrier column, the drive pivoting the barrier arm between a blocking position and an open position, the barrier arm is formed as a tube section having a rectangular cross-section with first and second side surfaces which face the motor vehicles approaching the access control apparatus along the lane, and the first and the second side surfaces of the barrier arm are either light-transmissive or transparent, a top surface of the barrier arm is connected to upper edges of the first and the second side surfaces of the barrier arm, and a bottom surface of the barrier arm is connected to lower edges of the first and the second side surfaces of the barrier arm, a light-impermeable separating wall having a first face and an opposite second face which are light-reflective, the separating wall being arranged within the barrier arm and extending diagonally in the tube section from the upper edge of the first side surface to the lower edge of the second side surface such that the separating wall forms an acute angle with each of the top surface and bottom surface of the barrier arm and such that the first face of the separating wall faces the first side surface and the bottom surface of the barrier arm, and the second face of the separating wall faces the second side surface and the top surface of the barrier arm, and the first lighting source comprises a first set of controllable LEDs arranged on the bottom surface of the barrier arm and the second lighting source comprises a second set of controllable LEDs arranged on the top surface of the barrier arm, the top and the bottom surfaces of the barrier arm are arranged parallel to a plane of the lane in the blocking position of the barrier arm, the first and the second sets of LEDs shine in a direction toward the separating wall, and the first set of LEDs on the bottom surface of the barrier arm are independently controllable from the second set of LEDs on the top surface of the barrier arm.

* * * * *